US005388304A

United States Patent [19]

Takada

[11] Patent Number: 5,388,304

[45] Date of Patent: Feb. 14, 1995

[54] DUST REMOVING SYSTEM FOR PANELLIKE BODIES

[75] Inventor: Sanae Takada, Osaka, Japan

[73] Assignee: Shinko Co., Ltd., Osaka, Japan

[21] Appl. No.: 715

[22] Filed: Jan. 5, 1993

[30] Foreign Application Priority Data

Apr. 13, 1992 [JP] Japan ..... 4-031327[U]

[51] Int. Cl.[6] ..... A47L 5/14

[52] U.S. Cl. ..... 15/345; 15/308; 15/404

[58] Field of Search ..... 15/345, 346, 379, 404, 15/405, 302, 303, 308, 306.1, 420, 422; 116/137 A, DIG. 18

[56] References Cited

U.S. PATENT DOCUMENTS

| | | | |
|---|---|---|---|
| 2,818,595 | 1/1958 | Rosewall | 15/422.1 |
| 3,239,863 | 3/1966 | Gardner | 15/308 |
| 3,416,487 | 12/1968 | Greene | 116/137 A |
| 4,026,701 | 5/1977 | Till et al. | 15/345 |
| 4,042,996 | 8/1977 | Wessells et al. | 15/303 |
| 4,461,651 | 7/1984 | Hall | 15/404 |
| 4,594,748 | 6/1986 | Warfvinge | 15/345 |
| 4,677,704 | 7/1987 | Huggins | 15/404 |
| 4,727,614 | 3/1988 | Swistun | 15/345 |
| 5,174,829 | 12/1992 | Gray | 15/345 |
| 5,224,235 | 7/1993 | Lison et al. | 15/345 |
| 5,265,298 | 11/1993 | Young | 15/345 |
| 5,279,017 | 1/1994 | Foreshew | 15/345 |

*Primary Examiner*—Timothy F. Simone
*Assistant Examiner*—James F. Hook
*Attorney, Agent, or Firm*—Armstrong, Westerman, Hattori, McLeland & Naughton

[57] ABSTRACT

A bottom wall of an air discharging chamber in a cleaner head is formed with an air jetting slit. The air jetting slit is arranged in the substantially perpendicular direction to the advancing direction of a panellike body. A bottom wall of an air sucking chamber in the cleaner head is provided with an air sucking slit located in parallel with the air jetting slit. The air discharging chamber includes a supersonic generator therein. The supersonic generator is provided with a continuous groove in parallel with the air jetting slit. The air is turned into an air flow incorporating ultrasonic waves after being passed through the continuous groove, and is successively jetted from the air jetting slit.

12 Claims, 5 Drawing Sheets

DUST REMOVING SYSTEM FOR PANELLIKE BODIES

BACKGROUND AND SUMMARY OF THE INVENTION

The present invention relates to improvements in a dust removing system for panellike bodies.

There is known a conventional type dust removing system of such a kind, which clears away fine particles of dust adhering to a surface 102 of a traveler means 101 in a configuration of belting as shown in FIGS. 9 and 10. (See, for example, Japanese Patent Gazette to Public Inspection No. 1-284378).

Specifically, the conventional dust removing system of this kind has a pair of blade members 103, 103 arranged at predetermined intervals of place in the direction in which they intersect the running direction A of the belting type traveler means 101 at substantially right angles. With such arrangement, the inside atmosphere between these blades members 103 and 103 is sucked in the direction marked with the arrow head a as shown in FIG. 9, to thereby allow the outside atmosphere to be introduced between the blade members 103 and 103 from clearance portions 108, 108 between the surface 102 of the belting type traveler means 101 running in the direction of the arrow head A and edge portions 107, 107 of the blade members 103, 103.

In this case, outside surfaces 104, 104 of the blade members 103, 103 are formed with concave portions 105, 105 in their end portions. Therefore, if the outside atmosphere is sucked between the blade members 103 and 103 from the clearance portions 108, 108, atmospheric flow is created as shown in the arrow head 110 around or adjacent the clearance portions 108, 108.

This atmospheric flow is brought between the blade members 103 and 103 at a high speed from the clearance portions 108, 108 after being depressed by means of the concave portions 105, 105 of the end portions of the blade members 103, 103. This reduces a boudary layer 109 formed over the surface 102 of the belting type traveler means 101. As a result, dust adhering to this surface 102 can be removed as much as the boundary layer 109 is reduced.

However, even if the boundary layer 109 is decreased, the boundary layer still remains, and this includes such dust. For this reason, the conventional dust removing system of the foregoing construction can not achieve the removal of such much dust. This is a disadvantage of the conventional dust removing system.

It is therefore an object of the present invention to provide for an improved dust removing system which ensures the complete removal of fine dust particles or the like from panellike bodies.

Also, it is an object of the present invention to provide for an improved dust removing system in which the dust removal is evenly feasible at any surface portion of a panellike body.

BRIEF DESCRIPTION OF THE DRAWINGS

The present invention will be described with reference to the accompanying drawings, in which.

DETAILED DESCRIPTION OF THE PREFERRED EMBODIMENTS

A preferred embodiment of the present invention will now be described in detail with reference to the accompanying drawings.

Figure 2:
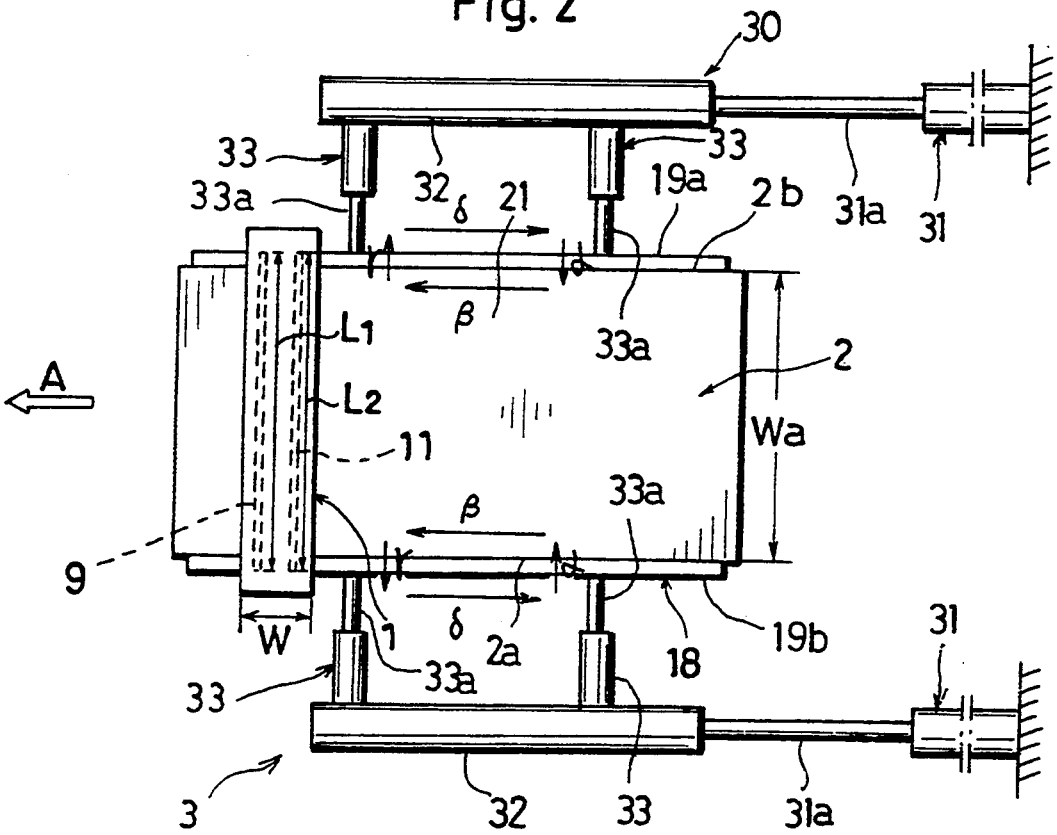
FIG. 2 is a schematic plan view of the dust removing system of FIG. 1, which explains the dust removing method thereof.
Figure 3:
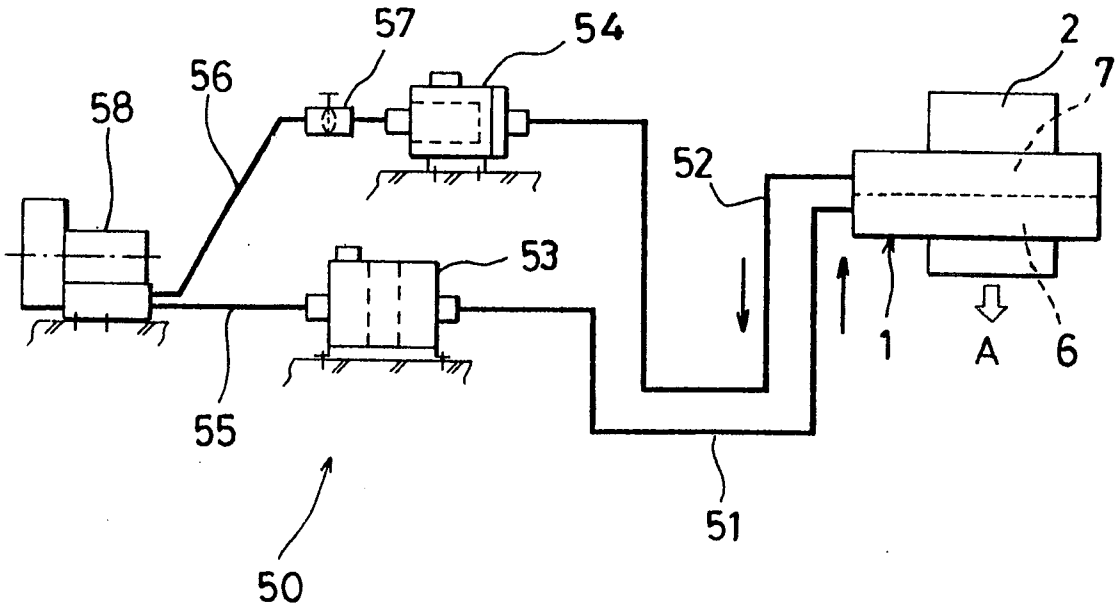
FIG. 3 is a schematic diagram which shows an overall arrangement of the dust removing system of FIG. 1.

FIG. 3 is a diagram to explain an overall arrangement of the dust removing system of the present invention according to a preferred embodiment thereof, and in this diagram, the dust removing system is provided with a cleaner head 1, a blower unit 50, and a transferring means 3 which allows a panellike body 2 to travel in the direction shown by means of the arrow head A. (See also FIGS. 2 and 5.)

The panellike body 2 is a flat rectangular such as a glass plate, a plastic plate, a ceramic plate or any other similar material.

The cleaner head 1 comprises a box body provided with

Also, as shown in FIG. 3, the air discharging chamber 6 has an air discharging conduit 51 communicatively connected thereto, and the air sucking chamber 7 has an air sucking conduit 52 joined thereto. With such arrangement, the air circulation is such that the air is fed to the air discharging chamber 6 from a blower unit 50 through the air discharging conduit 51, and the air within the air sucking chamber 7 is returned to the blower unit 50 through the air sucking conduit 52.

As also illustrated in FIG. 3, the blower unit 50 is provided with a filter member 53 communicatively connected to the air discharging conduit 51, a filter member 54 communicatively joined to the air sucking conduit 52, a blower motor 58, a junction conduit 55 communicatively connecting the blower motor 58 and the filter member 53 to each other, and a junction conduit 56 between the blower motor 58 and the filter member 54. Also, the junction conduit 56 has a damper 57 interposed therein.

Figure 1:
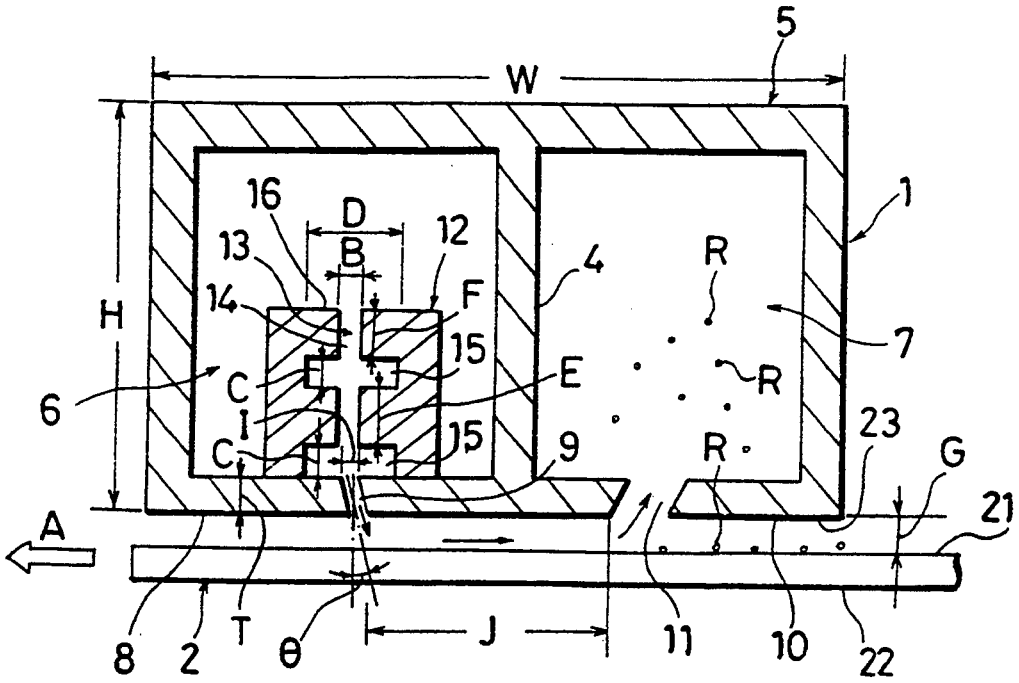
FIG. 1 is an enlarged sectional view of a principal portion of the dust removing system according to a first preferred embodiment of the present invention.

With such arrangement, as shown in FIG. 1, a bottom wall of the air discharging chamber 6 is formed with an air jetting slit 9 located in the substantially perpendicular direction to the advancing direction A of the panellike body, and a bottom wall 10 of the air sucking chamber 7 is provided with an air sucking slit 11 arranged in parallel with said air jetting slit 9.

The air jetting slit 9 is sloped downwardly towards the air sucking slit 11, and the air sucking slit 11 is downwardly slanted in the direction of the air jetting slit 9.

The width W of the cleaner head 1 is approximately 100 mm, and the height H of the cleaner head 1 is approximately 50 mm. The bottom wall 8 of the air discharging chamber 6 and that 10 of the air sucking chamber 7 are respectively approximately 3 mm in their thickness T.

Also, the air discharging chamber 6 is provided with a supersonic generator 12. This supersonic generator 12 comprises a block body which is provided with a continuous groove 13 located in parallel with the air jetting slot 9, and the continuous groove 13 comprises a vertical portion 14 and a pair of upper and lower horizontal portions 15, 15 which are communicatively connected to the vertical portion 14.

In the supersonic generator 12, preferably, the vertical portion 14 of the continuous groove 13 is approximately 1 mm in the width B thereof, and the horizontal portions 15, 15 of the groove 13 are approximately 3 mm in their respective height C. Also, the horizontal portions 15, 15 are desired to be approximately 6 mm in their width D, and to have distance E of some 6 mm therebetween. Moreover, the distance F between an upper surface 16 of the supersonic generator 12 and the upper horizontal portion 15 is preferably some 6 mm.

Figure 4:
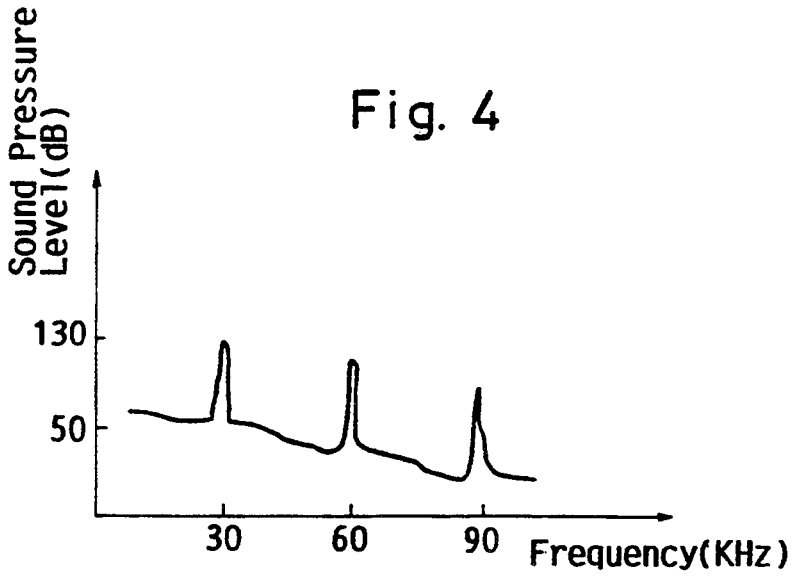
FIG. 4 is a graph which shows the relationship between the frequency and the sound pressure level for ultrasonic waves emitted from a supersonic generator included in the dust removing system according to the first preferred embodiment of the present invention.

Therefore, in the supersonic generator 12 constructed as described in the preceding, if air of 900 mmAq to 1600 mm Aq in pressure is passed through the continuous groove 13 at a speed of 100 m/sec to 200 m/sec, an air vibration is created owing to the internal concave and convex shape of the continuous groove 13 as well as said air speed, to thereby obtain ultrasonic waves of more than 20 kHz which belongs to the specific frequency range. In this preferred embodiment of the present invention, ultrasonic waves of 30 kHz of a multiple frequency can be obtained as shown in FIG. 4.

In this case, it is preferable that the air discharging slit 9 is approximately 10 degrees in the slanting angle Θ thereof and is approximately 0.5 mm to approximately 1.2 mm in the width thereof, and the distance J between the air jetting slit 9 and the air sucking slit 11 is 20 mm. However, the slanting angle Θ of the air jetting slit 9 is not limited to the preceding specified value, and can be any other suitable value.

Figure 6:
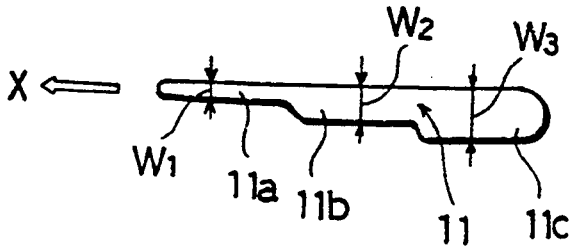
FIG. 6 is a bottom view of an air sucking slit included in the dust removing system according to the first preferred embodiment of the present invention.

Also, the air sucking slit 11 comprises, for example, a small-sized portion 11*a*, a middle-sized portion 11*b* and a large-sized portion 11*c*, as shown in FIG. 6. The small-sized portion 11*a* is approximately 2 mm in the width w1 thereof, the middle-sized portion 11*b* is approximately 6 mm in the width w2 thereof, and the large-sized portion 11*c* is approximately 10 mm in the width w3 thereof. The dimensions of the respective portions are set so that the air sucking force is substantially equal in any portion of the air sucking slit over the entire length thereof if the air is sucked in the direction of X as shown in FIG. 6. That is to say, the air sucking force is decreased from the small-sized portion 11*a* to the large-sized portion 11*c*, the air sucking slit 11 is accordingly increased in the width of the respective portions thereof.

However, needless to say, the air sucking slit 11 may be linearized without any of the small-sized portion 11*a*, the middle-sized portion 11*b* and the large-sized portion 11*c*. Also, the slanting angle of the air sucking slit may be freely set unless any special trouble results. The air sucking slit 11 can fulfill the functional purpose thereof only if it meets the minimum requirement in which it can suck 90% to 95% of the air amount blown off from the air jetting slit 9.

The frequency of the ultrasonic wave produced by means of the supersonic generator 12 depends chiefly upon the air velocity, and the shape and dimensions of the continuous groove 13. Therefore, if changes are made in the width and height of the vertical portions 14 of the continuous groove 13, and those of the horizontal portion 15 thereof, the ultrasonic waves obtained from the supersonic generator 12 can be also varied in the frequency thereof.

The transferring means 3 is provided with, for example, a panel holding means 18 and a driving means 30 which allows the panellike body 2 to travel in the direction of the arrow head A as shown in FIG. 2 while being horizontally held by means of the panel holding means 18.

Figure 5:
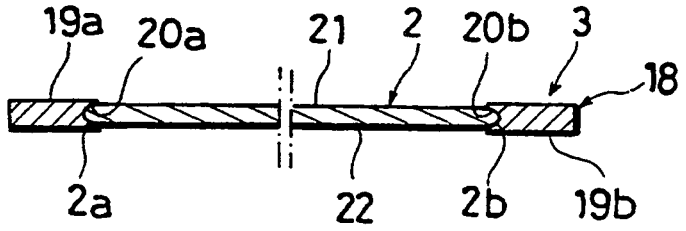
FIG. 5 is a cross sectional view of a transferring means included in the dust removing system according to the first preferred embodiment of the present invention.

The panel holding means 18 includes a pair of holder means 19*a*, 19*b* and these holder means 19*a*, 19*b* operate to hold the side end portions 2*a*, 2*b* of the panellike body 2. Specifically, as shown in FIG. 5, the side end portions 2*a*, 2*b* of the panellike body are respectively shaped in a convex configuration, while on the other hand, the holder means 19*a*, 19*b* are formed with concave grooves 20*a*, 20*b* on their surfaces which correspond to the side end portions 2*a*, 2*b* of the panellike body. The side end portions 2*a*, 2*b* of the panellike body are fitted into the concave grooves made in the holder means 19*a*, 19*b*.

Also, the driving means 30 is provided with a pair of oil-hydraulic or pneumatic cylinders 31, 31 which have piston rods 31*a*, 31*a* moved into or out of them in the longitudinal direction of the panellike body, moving blocks 32, 32 which are connected to the piston rods 31*a*, 31*a* of the cylinders 31, 31, and a pair of oil-hydraulic or pneumatic cylinders 33, 33 attached to the moving blocks 32, 32.

The piston rods 33*a*, 33*a* of the cylinders 33, 33 are respectively connected to the holder means 19*a*, 19*b* of the panel holding means 18, and are reciprocated in the perpendicular direction to the direction of the arrow head A in which the panellike body travels.

With such arrangement, in order to convey the panellike body 2 by using the transferring means 3, the piston rods 33*a* of the cylinders 33 are forward stretched to hold the side end portions 2*a*, 2*b* of the panellike body 2 by means of the holder means 19*a*, 19*b* of the panel holding means 18.

Next, the piston rods 31*a* of the cylinders 31, 31 are forward moved to send the holder means 19*a*, 19*b* in the direction of the arrow head A, and thereafter, the piston rods 33*a*, 33*a* of the cylinders 33, 33 are returned into the cylinders 33, 33 to detach the holder means 19*a*, 19*b* from the side portions 2*a*, 2*a* of the panellike body 2.

Subsequently, the piston rods 31*a*, 31*a* of the cylinders 31, 31 are returned into the cylinders 31, 31 to move the holder means 19*a*, 19*a* in the reverse direction of the direction indicated by means of the arrow head A.

The successive operation of the preceding piston rods 31*a*, 31*a* and 33*a*, 33*a* and holder means 19*a*, 19*a* allows a plurality of panellike bodies to travel by turns in the direction of the arrow head A. In this case, the holder means 19*a*, 19*b* are respectively moved as shown in the arrow heads $\alpha$, $\beta$, $\tau$ and $\delta$.

Therefore, the employment of the transferring means 3 provided with the panel holding means 18 as described in the foregoing can hold each panellike body horizontally without interfering with the upside surface 21 and underside surface 22 thereof, and can simultaneously achieve the movement of the panellike body in the direction of the arrow head A.

Also, the cleaner head 1 is arranged adjacent the panellike body 2, and the distance G between the upside surface 2 of the panellike body 2 and the underside surface 23 of the cleaner head 1 is preferably approximately 1 mm to 3 mm. See FIG. 1.

Next described is a manner in which dust R adhering to the upside surface 21 of the panellike body 2 is removed by using the dust removing system of the present invention which is arranged as described in the foregoing.

The panellike body 2 horizontally held by means of the panel holding means 18 of the transferring means 3 is moved in the direction indicated by using the arrow head A, as shown in FIGS. 1 and 2. In this case, air of 900 mmAq to to 1600 mmAq in pressure is fed into the air discharging chamber 6 of the cleaner head 1 from the air blower unit 50.

The air fed into the air discharging chamber 6 is advanced through the continuous groove 13 of the supersonic generator 12 at a high speed of 100 mm/sec to 200 mm/sec. This air is turned into an air flow which incorporates ultrasonic waves, because it has passed the continuous groove 13, and this air flow is Jetted from the air jetting slit 9 in parallel with-the slanting angle $\Theta$ thereof as indicated by means of the arrow head marked at the air jetting slit in FIG. 1.

Figure 8:
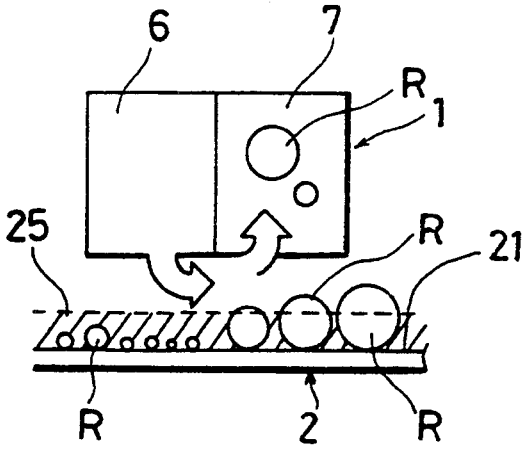
FIG. 8 is an explanatory diagram of what is called the air-knife operation applied in the dust removing system according to the first preferred embodiment of the present invention.
Figure 9:
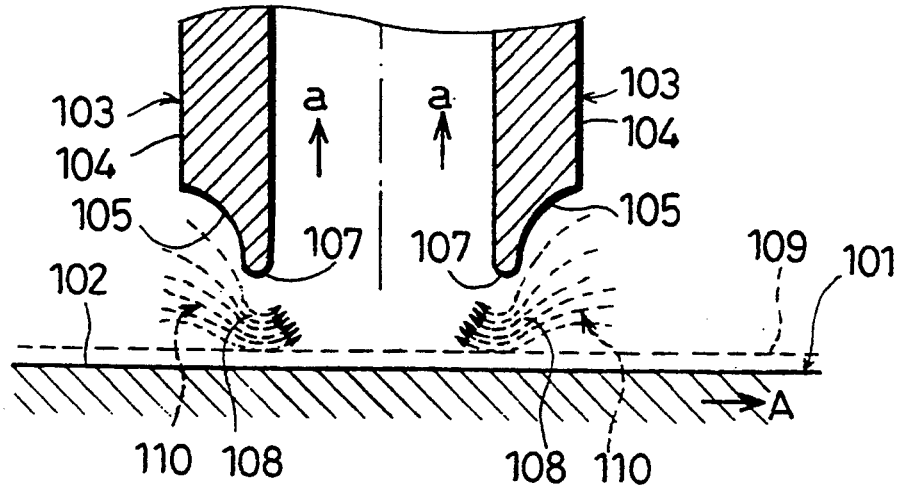
Fig. 9 Prior Art
FIG. 9 is an enlarged sectional view of a principal portion of a conventional dust removing system of the same kind as that according to the present invention.
Figure 10:
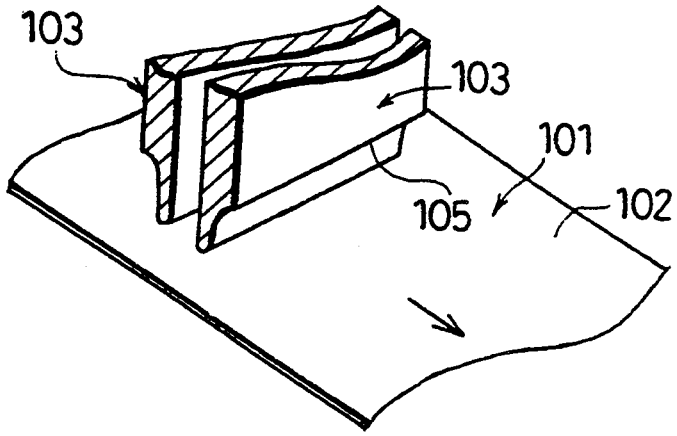
Fig. 10 Prior Art
FIG. 10 is a perspective view of a principal portion of the conventional dust removing system.

As shown in FIG. 8, coarse particle type dust of, for example, 50 $\mu$m to 80 $\mu$m is separated from the upside surface 21 of the panellike body 2 as a result of what is called the air knife operation of the air flow, while on the other hand, fine particle type dust which adheres to the panellike body 2 is confined in boundary layers 25 if the air is passed at a high speed along the upside surface 21 of the panellike body 2.

Figure 7:
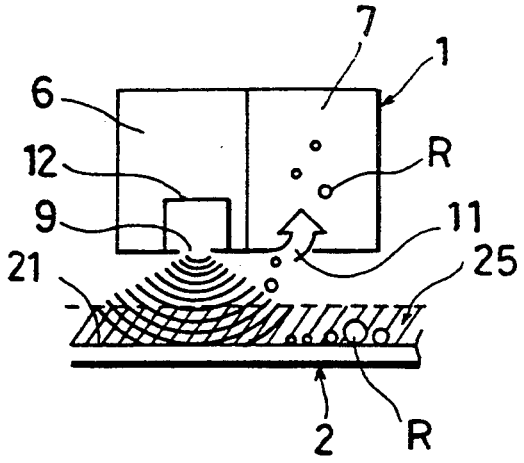
FIG. 7 is an explanatory diagram of dust removing supersonic operation used in the dust removing system according to the first preferred embodiment of the present invention.

However, according to the dust removing system of the present invention, the ultrasonic waves produced by means of the supersonic generator function to rupture the boundary layers 25, as shown in FIG. 7, to thereby separate fine particle type dust from the upside surface 21 of the panellike body 2. It is the vibratory energy that achieves the rupture of the boundary layer 25. In this case, the ultrasonic waves promote the separation of the coarse particle type dust from the upside surface 21 of the panellike body 2 which is attained by the air knife effect.

As is apparent from the preceding description, in the dust removing system according to the present invention, it is ensured that dust R which adheres to the upside surface 21 of the panellike body 2 is separated therefrom. The dust R separated from the upside surface of the panellike body around or adjacent the air sucking port 11 is sucked into the air sucking chamber 7 together with the air as shown by means of the arrow head marked at 11, because the air located within the air sucking chamber 7 is sucked into the blower unit 50 under pressure of 50 mmAq to 250 mmAq. This achieves the infalliable removal of dust R from the upside surface 21 of the panellike body 2 which has finished the advancing movement thereof under the cleaner head 1.

In this case, the length L1 of the air discharging slit 9 and the length L2 of the air sucking port 11 are desired to be set so as to be greater than the width Wa of the panellike body 2 as shown in FIG. 2. This dimensional requirement is preferably met for any size of panellike body from which dust is to be removed, by changing such length L1 and L2 according to the size of the panellike body.

According to the present invention, since the air flow which incorporates ultrasonic waves therein is emitted from the air jetting slit 9 located in the substantially perpendicular direction to the advancing direction A of the panellike body, such that the air flow amount is equal in any portion of the upside surface of the panellike body, it is ensured that dust R adhering to the panellike body 2 is separated from this panellike body. The dust thus separated from the panellike body is infalliably sucked into the air sucking chamber 7 from the air sucking port 11 located in parallel with the air jetting slit 9, to thereby remove any dust R which floats over the panellike body 2.

Moreover, the removal of the dust R which floats over the panellike body 2 is also achieved by using both the air-knife operation and the dust removing supersonic operation of the air flow which incorporates ultrasonic waves therein.

The dust removing system according to the present invention is suitable for the removal of ultrafine particles of 1 $\mu$m to 20 $\mu$m in grain size.

Although the present invention has been fully described by way of examples with reference to the accompanying drawings, it is to be noted here that various changes and modifications will be apparent to those skilled in the art. Therefore, unless otherwise such changes and modifications depart from the scope of the present invention, they should be construed as being included therein.

For example, the transferring means 3 may be of the belt conveyor type, or may be such that it is provided with a mechanism to allow it to stick to the underside 22 of the panellike body 2.

Also, the cleaner head 1 is preferably fitted with a noise arresting cover, because during the dust removing operation of the system according to the present invention, noises are made when the air passes the air jetting slit 9, when the air is sucked into the air sucking chamber 7, and when ultrasonic waves are produced from the supersonic generator.

I claim:

1. A dust removing system for panellike bodies, comprising:

air blower means;

air sucking means;

means for advancing the panellike bodies in an advancing direction;

a cleaner head which includes an air discharging chamber which emits air supplied from the air blower means to a panellike body, an air sucking chamber which removes dust adhering to the panellike body to the air sucking means, a bottom wall of the air discharging chamber being formed with an air jetting slit having an elongated outlet which extends substantially across the width of the panellike body in a substantially perpendicular direction to the advancing direction of the panellike body, said air discharging chamber being provided with a supersonic generator which incorporates ultrasonic waves in an air flow emitted from the air jetting slit of the air discharging chamber, said supersonic generator including a groove which leads to said air jetting slit, through which groove air supplied from said air blower means passes, said groove having a shape which creates ultrasonic waves owing to the air speed at which the air is passed therethrough, and a bottom wall of the air sucking chamber being formed with an air sucking slit having an elongated inlet which extends generally in parallel with the air jetting slit.

2. A dust removing system for panellike bodies, comprising:

air blower means;

air sucking means;

means for advancing the panellike bodies in an advancing direction;

a cleaner head which includes an air discharging chamber which has an air jetting slit having an elongated outlet extending substantially across the width of the panellike body in a substantially perpendicular direction to the advancing direction of the panellike body to jet air onto a panellike body from the air blower means, the air discharging chamber including a supersonic generator which incorporates ultrasonic waves in a flow of air jetted out of the air jetting slit, said supersonic generator including a groove which leads to said air jetting slit, through which groove air supplied from said air blower means passes, said groove having a shape which creates ultrasonic waves owing to the air speed at which the air is passed therethrough, and an air sucking chamber having an air sucking slit which sucks the air flow jetted onto the panellike body towards said air sucking means so that the dust floating over the panellike body is simultaneously sucked.

3. The dust removing system for panellike bodies as set forth in claim 1 or 2, wherein the panellike body is a flat rectangular material selected from the group consisting of a glass plate, a plastic plate, and a ceramic plate.

4. The dust removing system for panellike bodies as set forth in claim 1 or 2, wherein the supersonic generator is provided with a continuous groove including a vertical portion and a pair of upper and lower horizontal portions communicatively connected to the vertical portion, and the continuous groove is arranged in parallel with the air jetting slit.

5. The dust removing system for panellike bodies as set forth in claim 1 or 2, wherein the air jetting slit is successively sloped downwardly in the direction of the air sucking slit.

6. The dust removing system for panellike bodies as set forth in claim 1 or 2, wherein the air sucking slit is successively sloped downwardly in the direction of the air jetting slit.

7. The dust removing system for panellike bodies as set forth in claim 1 or 2, wherein air of 900 mmAq to 1600 mmAq in pressure is passed through the continuous groove of the supersonic generator at a speed of 100 m/sec to 200 m/sec to produce from the supersonic generator ultrasonic waves of 12 kHz to more than 20 kHz which belongs to a specific frequency.

8. The dust removing system for panellike bodies as set forth in claim 1 or 2, wherein the air within the air sucking chamber 7 is sucked under sucking pressure of 50 mmAq to 250 mmAq.

9. The dust removing system for panellike bodies as set forth in claim 1 or 2, wherein 90% to 95% of the air amount jetted from the air jetting slit is sucked into the air sucking slit.

10. The dust removing system for panellike bodies as set forth in claim 1 or 2, wherein a transferring means is provided which moves the panellike body while holding opposed side portions of the panellike body by means of holder means.

11. The dust removing system for panellike bodies as set forth in claim 1 or 2, wherein the distance between the upside surface of the panellike body and the underside surface of the cleaner head is 1 mm to 3 mm.

12. The dust removing system for panellike bodies as set forth in claim 1, wherein said bottom wall of the air discharging chamber is located between 1–3 mm above a top surface of the panellike body.

* * * * *